United States Patent [19]

Bouchard et al.

[11] 4,369,556

[45] Jan. 25, 1983

[54] METHOD OF MAKING A PHOTOFLASH LAMP HAVING NEW LEAD SEAL STRUCTURE

[75] Inventors: Andre C. Bouchard, Peabody; Harold H. Hall, Jr., Marblehead; Frederick A. Loughridge, Ipswich, all of Mass.

[73] Assignee: GTE Products Corporation, Stamford, Conn.

[21] Appl. No.: 170,509

[22] Filed: Jul. 21, 1980

[51] Int. Cl.[3] ..... H01J 9/32

[52] U.S. Cl. ..... 29/25.15; 29/25.13

[58] Field of Search ..... 29/25.13, 25.15, 25.16; 316/19, 20; 431/362

[56] References Cited

U.S. PATENT DOCUMENTS

| | | | |
|---|---|---|---|
| 2,235,515 | 3/1941 | Carpenter | 29/25.15 |
| 2,428,059 | 9/1947 | Wolfson . | |
| 3,178,796 | 4/1965 | Smits . | |
| 3,263,457 | 8/1966 | Reiber | 431/362 |
| 3,290,906 | 12/1966 | Schilling et al. . | |
| 3,752,636 | 8/1973 | Warnick | 431/362 |
| 3,884,615 | 5/1975 | Sobieski | 431/362 |
| 3,959,860 | 6/1976 | Schindler | 29/25.16 |
| 4,097,220 | 6/1978 | Cote et al. | 431/362 X |

*Primary Examiner*—Kenneth J. Ramsey

*Attorney, Agent, or Firm*—Lawrence R. Fraley

[57] ABSTRACT

A method of making an electrically-activated photoflash lamp which includes a lead glass envelope, a quantity of shredded zirconium or hafnium combustible material and an ignition structure disposed within the envelope for igniting the combustible material upon application of a high voltage, low energy pulse thereto. The ignition structure includes a pair of metallic lead wires secured within one end of the envelope and having terminations which lie substantially flush with the interior surface of this end. A quantity of primer material bridges the terminations and is ignited upon application of the above pulse. The lead wires are secured and hermetically sealed within the envelope's end while the bulb is inverted, without the need for a press sealing operation. A method of axially adjusting the ends of the lead wires with respect to the bulb while the seal is hot is also disclosed.

17 Claims, 9 Drawing Figures

METHOD OF MAKING A PHOTOFLASH LAMP HAVING NEW LEAD SEAL STRUCTURE

DESCRIPTION

Technical Field

The present invention relates to electrically-activated photoflash lamps and methods of making such lamps.

Lamps of the above type are generally classified into two varieties: low-voltage and high-voltage. Low-voltage photoflash lamps typically include a glass envelope with a combustion-supporting gas (e.g., oxygen) and a quantity of filamentary, combustible material (e.g., shredded zirconium) therein. A pair of electrically conductive lead-in wires are usually sealed in one end of the envelope and extend therein. A filament is utilized and interconnects the extending ends of the wires. When the filament is heated by a firing current usually generated from a low-voltage source such as battery or charged capacitor (e.g., having a voltage of from about 1.5 to 15 volts), it ignites a primer material which then ignites the combustible material to produce a flash of light. Naturally, the oxygen gas aids in the above ignition. In high-voltage lamps, the use of a filament is usually excluded by the provision of a glass or ceramic bead in which are located the extending ends of the lamp's conductive lead-in wires. Primer material serves to bridge the portions of these ends which project through the bead. High-voltage lamps also include the aforedescribed filamentary material and combustion-supporting gas. Flashing is accomplished by a low energy firing pulse approaching a few thousand volts and usually provided by a piezoelectric element. In another type of high-voltage lamp, the primer is located within an indentation in the bottom of the lamp and the conductive lead-in wires extend therein.

The teachings of the instant invention are particularly concerned with high voltage lamps, although it will be understood from the following that said teachings may be readily extended to lamps of the earlier generation, low voltage variety. The teachings of the invention are even more particularly concerned with such lamps that are of the subminiature variety (e.g., those having an internal envelope volume of less than about 0.300 cubic centimeters).

BACKGROUND

In all of the above varieties of lamps, the conductive lead-in wires which form part of the lamp's ignition structure are typically sealed within one end of the lamp's envelope using a press (or "pinch") sealing operation during which the glass comprising this end portion is heated and compressed by a pair of opposing, parallel-faced metallic press members which converge to engage the heated glass. At least one engagement per lamp is required and on some occasions, two or three are employed. Examples of such lamps are illustrated in U.S. Pat. Nos. 3,290,906 (Schilling et al), 3,752,636 (Warninck) and 3,884,615 (Sobieski). While such a technique has proven to successfully provide a hermetic seal of the metallic lead-in wires, the requirement of using a press seal possesses several drawbacks, particularly with regard to small volume lamps such as those of the subminiature type. Firstly, there exists a strong tendency for the two wires to "swim" within the molten glass during pressing, which in turn can result in the two becoming misaligned. This situation is understandably intolerable in subminiature photoflash lamps where precisioned, spaced-apart orientation is essential. Secondly, a press-sealed end adds appreciably to the overall length of the lamps envelope, a highly desirable feature serving to defeat miniaturization efforts. Thirdly, the necessity for using a press seal adds to the overall costs of producing the lamp in that such a technique understandably requires complex lamp manufacturing equipment, which itself is both costly to produce and operate.

It is believed therefore that a method of making an electrically-activated photoflash lamp which can be readily produced without the need for a press seal end portion while still possessing a sound, hermetically sealed envelope would constitute a significant advancement in the art.

DISCLOSURE OF THE INVENTION

It is, therefore, a primary object of the instant invention to provide a method of making an electrically-activated photoflash lamp wherein the lamp comprises a hermetically sealed glass envelope not including the aforementioned press (or pinch) seal.

In accordance with one aspect of the invention, there is provided a method of making an electrically activated photoflash lamp, said method comprising the steps of: (1) retaining a glass tubing member having first and second opposing open ends; (2) positioning a pair of electrical conductors within the first end such that the conductors project a predetermined distance within the glass tubing member; (3) heating preselected external areas of the tubing member's first end to cause this end portion to deform and surround the conductors in such a manner that a positive hermetic seal is provided therewith without covering of the conductor's terminations by the end portion's glass material; (4) applying a quantity of primer material to the terminations of the conductors; (5) positioning a quantity of combustible material within the tubing member through the remaining open end portion; and (6) thereafter sealing the remaining second open end of the tubing member to define a hermetically sealed envelope.

BEST MODE FOR CARRYING OUT THE INVENTION

For a better understanding of the present invention, together with other and further objects, advantages and capabilities thereof, reference is made to the following disclosure and appended claims in connection with the above-described drawings.

Figure 1:
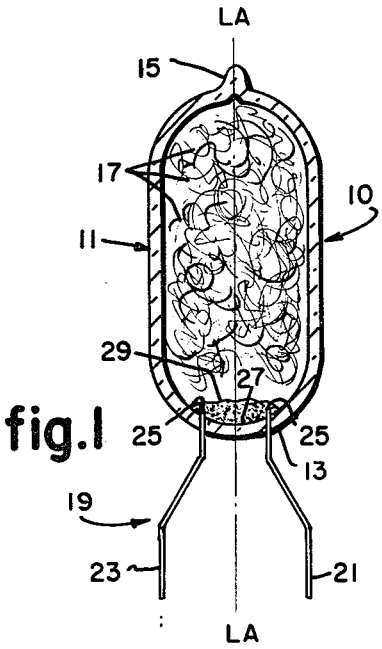
FIG. 1 is an elevational view, in section, of an electrically-activated photoflash lamp in accordance with a preferred embodiment of the invention.

With particular reference to FIG. 1, there is shown an electrically-activated photoflash lamp 10 in accordance with the preferred embodiment of the invention. Lamp 10 includes an hermetically sealed, light-transmitting glass envelope 11 having first and second opposing sealed end portions 13 and 15 respectively. The preferred glass material for envelope 11 is sold by the assignee of the instant invention under the product designation SG10 and is a potash soda lead glass having a typical chemical composition, by weight, of about 61% silica dioxide, 21.5% lead oxide, 7.7% sodium oxide, 7.45% potassium oxide, 2.1% alumina oxide, 0.15% arsenic trioxide and 0.1% calcium oxide. SG10 glass also has a thermal expansion rating of 93.1, an annealing point of about 432 degrees Celsius, a softening point of about 626 degrees Celsius, and a dielectric constant of 6.7. While the above material is preferred, it is understood that other soft glasses heretofor used in the photoflash industry, e.g., soda lime glasses, could also be used with the invention as well as the harder glasses, e.g., quartz and borosilicate.

Located within envelope 11 is a quantity of filamentary combustible material 17 for providing a high intensity flash of light upon ignition thereof, the preferred material being shredded zirconium or hafnium. A quantity of about 3 to 7 milligrams is used; it is of course understood that increasing the quantity of material 17 will cause a corresponding increase in the internal pressure of envelope 11. Utilization of from 3 to 7 milligrams is preferred in lamps having internal volumes within the range of from about 0.005 cubic centimeters to about 0.300 cubic centimeters, the preferred size for the lamp envelopes of the present invention. Accordingly, lamp 10 is defined as being of the sub-miniature variety and the teachings of the instant invention are particularly directed to such lamps. It is understood, however, that the teachings of the invention may also apply to lamps having substantially larger volumes and particularly to those having internal volumes equal to or less than one cubic centimeter.

Also within envelope 11 is a combustion-supporting gas, e.g., oxygen, established at a pressure within the range of about 10 to about 40 atmospheres. The oxygen gas understandably serves to promote burning of shredded material 17 upon lamp ignition. Lamp 10 further includes an ignition means 19 disposed within end 13 for igniting the shredded zirconium or hafnium upon application of a suitable pulse as may be provided by a power source associatd with many of today's electric cameras. One example of such a source is a piezoelectric element which is capable of providing a high voltage, low energy pulse approaching 5,000 volts. This element is typically located within the camera and provides said pulse through the camera's circuitry to a corresponding socket in which the photoflash device (which includes several lamps 10) is inserted. Accordingly, it is understood that the photoflash lamp of the instant invention is particularly adapted for use with multilamp photoflash devices and particularly those which depend on high voltage, low energy pulses to achieve sequential ignition of the lamps contained therein.

Ignition means 19 includes a pair of spaced-apart electrical conductors 21 and 23 which are hermetically sealed within end 13 of envelope 11 and project therefrom. Accordingly, the aforementioned high voltage pulse is applied across conductors 21 and 23 to in turn ignite means 19, which in turn almost instantaneously ignites combustible 17. Conductors 21 and 23 are metallic wires having a diameter of 0.016 inch and are each comprised of a nickel iron alloy sold under the tradename Niron. Each wire, as stated, is hermetically sealed within end 13. As shown in FIG. 1, the terminations 25 of these wires lie substantially flush with the internal surface 27 of envelope 11 as defined by end 13. Bridging terminations 25 is a quantity of primer material 29 which ignites upon application of the aforedefined high voltage pulse. As shown, terminations 25 are void of the envelope's glass material such that a sound electrical contact with primer 29 is assured. The unique manner of attaining this critical positioning relationship is defined below. Primer material 27 comprises a composition of zirconium and potassium perchlorate, with the zirconium comprising by weight approximately 85% of the composition and the potassium perchlorate comprising approximately 15% by weight of the composition. From about 0.30 milligrams to about 1.50 milligrams of primer material 29 is utilized in lamp 10.

When utilizing the aforedefined components in the ranges defined at the ratios cited, lamp 10, when ignited, is capable of providing a light output within the range of from about 600 lumen-seconds to about 2000 lumen-seconds, or from about 15 to 50% of the total output available from many larger photoflash lamps available on the marketplace today. The invention is capable of doing so by a substantial savings in material and size without an undue sacrifice in output. Specifically, the output provided by the instant invention adequately meets the needs of today's photoflash industry and particularly the needs of cameras which employ today's more sensitive and/or higher speed (ASA 400) films. By way of specific example, today's high voltage photoflash lamps require an envelope with an internal volume of approximately 1 cubic centimeter and are capable of providing outputs approaching only 4000 lumen-seconds.

Figure 2:
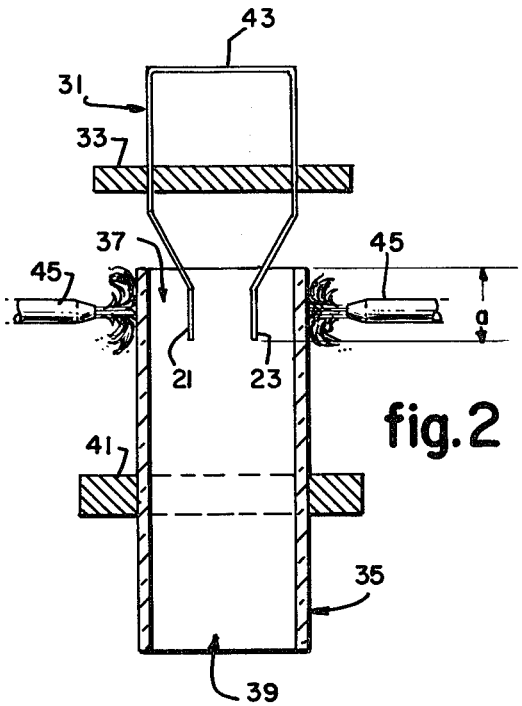
FIGS. 2–5 represent the preferred steps in manufacturing an electrically-activated photoflash lamp in accordance with the teachings of the invention.

In FIGS. 2–5, there are illustrated the preferred steps in the method of making lamp 10. In FIG. 2, a hairpin-shaped, lead wire structure 31 is illustrated as being positioned within a holder 33 located above a vertically oriented elongated piece of glass tubing 35 having opposing open ends 37 and 39. Tubing member 35 preferably has an external diameter of 0.175 inch, an internal diameter of 0.115 inch and an original length of approximately 2.00 inches. It is understood that tubing member 35 is to eventually comprise the envelope 11 illustrated in FIG. 1 subsequent to the several operations performed thereon (described below). Accordingly, member 35 is comprised of the aforementioned SG10 lead glass. Member 35 is securely retained within a second holder 41.

As illustrated, open end 37 is vertically positioned above the bottom open end 39 and the pair of projecting ends of the lead wire structure 31 are aligned so as to project vertically downwardly within end 37 and therefore inside of tubing member 35 a predetermined distance. It is understood that these projecting ends of structure 31 are eventually to comprise metallic lead wires 21 and 23 of finished lamp 10. Accordingly, said projecting wires are given the numerals 21 and 23 in FIGS. 2–5. Subsequent to sealing these projecting members within tubing 35, the hairpin-shaped structure 31 is released from holder 33 and the connecting element (43) removed therefrom.

Figure 3:
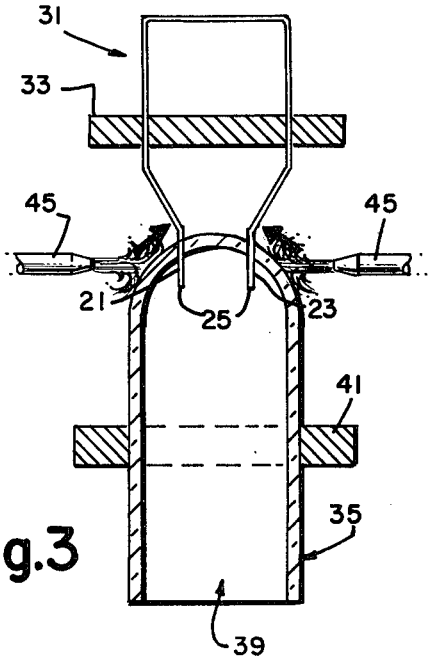

When using the glass tubing member 35 having the described internal diameter and wall thickness, it is preferred that the 0.016 inch diameter wires 21 and 23 project about 0.20 inch (dimension a) within open end 37. Once wires 21 and 23 are positioned therein in the manner illustrated in FIG. 2, heat is applied to preselected external areas of the open end portion 37 of tubing glass member 35 so as to raise the temperature thereof sufficiently to cause this end to deform, that is, to assume a plastic state. While in this state, end portion 37 assumes a beaded form about the projecting wires 21 and 23 such that the wires are surrounded in the manner depicted in FIG. 3. It is believed that this beading action is the result of surface tension forces acting upon the glass while in the described plastic state. The surprising result is a hermetic seal of end portion 37 with the conductors 21 and 23 sealed and secured therein. As shown in FIG. 3, this unique procedure provided the defined seal without the glass material covering the terminations of the respective wire members 21 and 23. The terminations (25) are thus free of glass and capable of providing the subsequent electrical contact with the lamp's primer material (to be applied later).

The defined application of heat to tubing member 35 is preferably accomplished by utilization of a pair of opposing gas-oxygen burners 45 located on opposing sides of the cylindrical tubing member. The preferred positioning relationship of the burners is better illustrated in FIG. 6. As shown therein, burners 45 are positioned on opposing sides of glass tubing member 35 (shown in a plan, sectional view) such that the preselected areas for heating will be those located on opposing sides of the plane PP occupied by the two projecting lead wires 21 and 23. Accordingly, the views shown in FIGS. 2 and 3 are for illustrative purposes only and do not represent the preferred burner positions. In the finished product, the plane PP occupied by the secured wires 21 and 23 passes through the longitudinal axis LA—LA (see FIG. 1) of the finished envelope 11. More specifically, the longitudinal axis of envelope 11 also occupies the plane PP and passes through end 13 between the spaced-apart wires 21 and 23 and at a location equidistant therefrom. Utilization of gas-oxygen or similar pressurized burners 45 is preferred over other forms of heating (e.g., resistance type) because the forces exerted by the impinging flames against the heated external surfaces of member 35 serve to accelerate the aforedescribed deforming and sealing operation.

Figure 6:
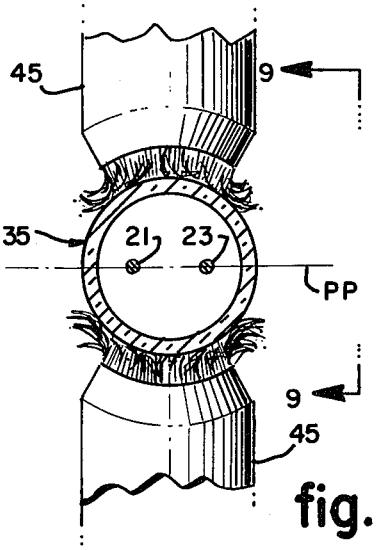
FIG. 6 is a plan view, partly in section, of the preferred method of applying heat to the sides of the glass tubing member which constitutes the envelope of the invention.
Figure 9:
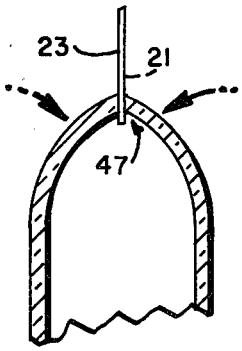
FIG. 9 is a partial side elevational view of the sealed end portion of the invention as taken along the line 9—9 in FIG. 6.

The preferred temperatures for heating open end portion 37 are within the range of between 600 degrees Celsius and 1150 degrees Celsius, depending on the glass material utilized. When heating the tubing member to these temperatures and while utilizing the defined strategic positioning of burners 45 (opposite the plane PP as depicted in FIG. 6), it was surprisingly found that a "sandwiching" type of collapse occurred about wires 21 and 23, resulting in addition to the described hermetic seal, in the formation of a small, longitudinal indentation or groove 47 (FIG. 9) which extended along the internal surface of the sealed end a distance at least equal to that of the spacing of wires 21 and 23. Accordingly, both wires were located within and along the deepest portions of the groove. It is understood in FIG. 9 that wire 21 (located directly behind and therefore hidden by wire 23) is also within groove 47. The formation of this groove represents a significant feature of the invention for at least two reasons. Firstly it greatly facilitates positioning of primer material 29 within the envelope such that the primer is assured of physically contacting the terminations 25 of both wires. Specifically, primer material 29 will occupy groove 47 and bridge both terminations. The described groove also enhances operation of the finished lamp in conjunction with other lamps in a multilamp device by providing a resevoir for the flashed primer material 29 subsequent to lamp flashing to thus assure an electrical path between the leads, if desired. Understandably, such a feature assists "shorting" between the leads during subsequent pulse applications (i.e., to flash additional, remaining lamps in the device) and therefore also removes the need for additional switching components in the device's circuit should the lamps of the device be connected in series.

Figure 4:
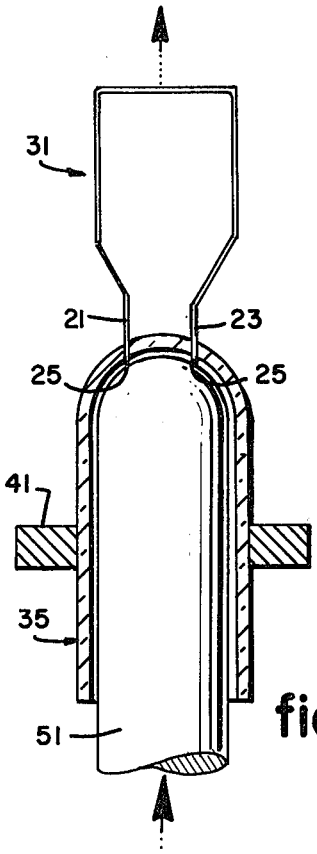

As shown in FIG. 1, the terminations 25 of wires 21 and 23 are substantially flush with the internal surface 27 of end 13. In FIG. 4 there is illustrated one of the preferred techniques for locating terminations 25 in this substantially flush relationship. More specifically, while the glass material remains in a heated and plastic state, a cooled rod member 51 is inserted through second open end 39 to physically engage terminations 25 and push (force) wires 21 and 23 through the heated glass material to the substantially flush relationship depicted. By the term cooled is meant that rod 51 is at a temperature less than that of the softening temperature of the glass material at this stage of the process. In one embodiment of the invention, rod 51, a cylindrical steel member having an external diameter of about 0.10 inch, was at room temperature at the initial stage of the described technique. Rod 51 performs two functions simultaneously. Firstly, it serves to engage (and therefore cover) the terminations 25 of conductors 21 and 23 to prevent molten glass flow over said terminations. Secondly, it pushes (forces) the leads to the substantially flush position.

Figure 5:
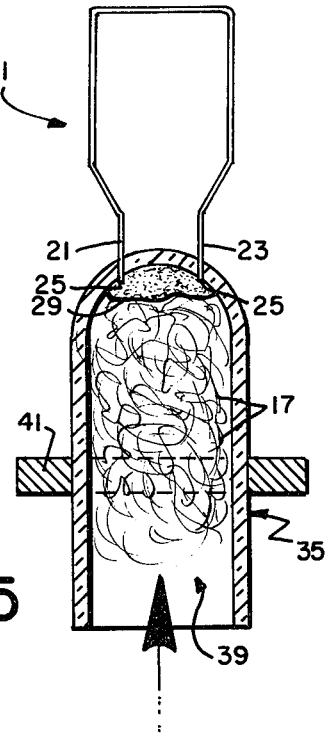

Subsequent to withdrawal of rod 51 through the remaining opening end 39 of tubing member 35, the aforementioned quantity of the primer material 29 is applied to terminations 25 in the manner depicted in FIG. 5. Any suitable applicator known in the art can be utilized for this purpose and further definition is not deemed necessary. It is understood however that the primer 29 is applied while in a liquid state and subsequently drys while in position. This drying can be facilitated by the introduction of air through second end 39. The shredded zirconium or hafnium material has been inserted within open end 39 to frictionally engage the internal side walls of tubing member 35 in the manner illustrated in FIG. 5. Glass tubing member 35 is then evacuated through open end 39, the tube is necked (constricted) down, and a quantity of the described combustion-supporting gas is introduced within the member 35 through end 39, and end 39 is thereafter sealed using a tipping off technique. Such a technique is well known in the art of manufacturing photoflash lamps and further definition is not deemed necessary. It is understood that the original 2.00 inch overall length for member 35 will now be substantially reduced. In one example of the invention, envelope 11 possessed an overall external length of about 0.500 inch.

Figure 7:
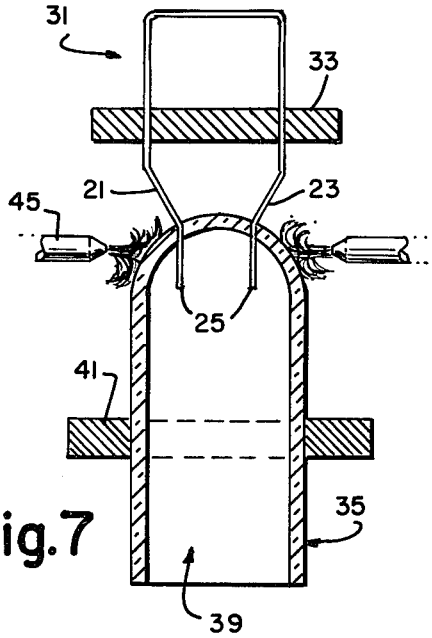
FIGS. 7 and 8 illustrate an alternate embodiment of a method of making the photoflash lamp shown in FIG. 1.
Figure 8:
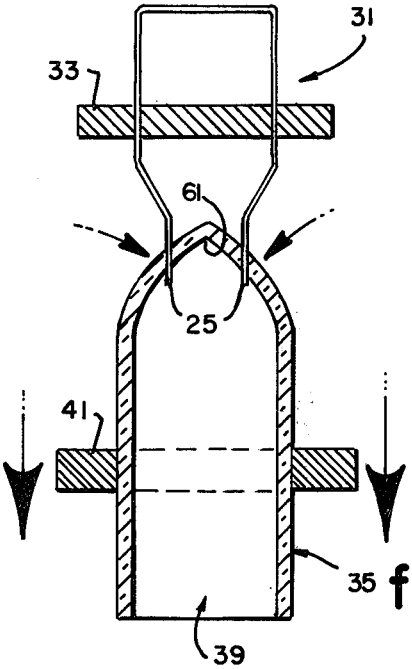

In FIGS. 7 and 8, there is illustrated an alternate technique for assuring the substantially flush positioning relationship between the terminations 25 of wires 21 and 23 and the interior end surface of tubing member 35. Rather than utilization of a cooled rod member as employed in the foregoing procedure, this positioning relationship can be achieved by heating the glass material (utilizing burners 45) and, while the glass material remains in the molten state, separating the tubing member 35 and lead structure 31 an established distance sufficient to assure the flush relationship. This separation may be accomplished by either: (1) retaining structure 31 in a fixed position and withdrawing holder 41 the established distance; (2) retaining the tubing in a fixed position while withdrawing in a vertical upward direction the holder 33 and corresponding lead structure 31 secured therein; or (3) moving both holders 33 and 41 apart the established distance in a simultaneous manner. For purposes of the invention, it is preferred to utilize the first of the above three alternatives. During this operation, it is permissible to locate the opposing burners 45 along the plane PP occupied by wires 21 and 23 such that they assume the positions illustrated in FIG. 7. Understandably, this positioning represents a rotational shift of about 90 degrees for each burner in comparison to the positions shown in FIG. 6. During the aforedescribed separation (FIG. 8), it was surprisingly found that a substantially conical-shaped pocket 61 was formed within the internal surface of this end portion, said pocket providing the unique features of the aforedefined indentation or groove 47. That is, primer 29 is located therein to bridge terminations 25. Also, the pocket serves as a reservoir for flashed primer 29. As shown in FIG. 8, the terminations 25 of wires 21 and 23 are located on opposite sides of pocket 61. It is understood that formation of pocket 61 will also occur when heating the tubing with burners 45 located in the relationship shown in FIG. 6.

In all of the above techniques, the downwardly projecting lead wires 21 and 23 were positioned within the upwardly located open end 37 so as not to engage the internal surfaces of this end portion of the glass tubing member. This alignment (FIG. 6) was considered necessary in order to accomplish the unique hermetic sealing described. It was also observed during all of the above techniques that direct exposure of wires 21 and 23 to the flames emitted by the gas-oxygen burners 45 on occasion resulted in the formation of a loose oxide layer on the wires. Such a layer could defeat formation of a sound hermetic seal between the glass and metal components and eventually result in gas leakage in the finished product. This potential problem was readily overcome by directing the burner flames only onto the designated glass surfaces. Understandably, utilization of other varieties of heaters may also prevent such occurrence. The use of the gas-oxygen burners 45 is preferred, however, for the reason cited.

There has thus been shown and described a new and unique process for forming a hermetic seal within an end of a glass envelope between the glass and the photoflash lamp's metallic lead wires secured within the end. The described techniques eliminate the need for the aforementioned press seal and therefore provide the several advantageous features described above. The lamp as produced in accordance with the teachings herein thus also possesses other advantageous features in comparison to known photoflash lamps which are electrically activated. For example, lamp 10 does not require the need for a glass or ceramic bead component within the envelope upon which the desired high voltage primer material may be positioned. As also described, the lamp of the invention is extremely small in comparison to most known lamps and yet is capable of providing light outputs approaching approximately 50% of these known lamps. Still further, the described technique for providing the sealed end of the lamp permits precisioned alignment of the metallic lead wires therein such that proper positioning of the desired primer material on the bottom wall of the envelope and in physical contact with the terminations of these wires is readily possible.

Although it has been shown to position the terminations of the electrical conductors of the invention substantially flush with the interior surfaces of the envelope's first end portion, this arrangement is not meant to limit the invention. That is, it is also within the scope of the invention to permit the terminations to project substantially within the envelope. Additionally, it is only necessary that one of the terminations be covered with primer in that electrical contact to the other can be provided by the electrically conductive filamentary combustible mass, if desired.

While there have been shown and described what are at present considered the preferred embodiments of the invention, it will be obvious to those skilled in the art that various changes and modifications may be made therein without departing from the scope of the invention as defined by the appended claims.

What is claimed is:

1. A method of making an electrically-activated photoflash lamp, said method comprising:

securedly retaining an elongated glass tubing member having first and second opposing open end portions such that said first open end portion is located vertically above said second open end portion;

positioning a pair of spaced-apart electrical conductors within said first open end portion of said glass tubing member such that said conductors project downwardly in a vertical direction a predetermined distance within said first open end portion;

heating preselected external areas of said first open end portion of said glass tubing member having said conductors projecting therein to a preestablished temperature to cause said first open end portion of said glass tubing member to deform and surround said conductors projecting downwardly therein and provide a seal therewith, said deformation resulting in the formation of a groove along the internal surface of said sealed first end portion such that said conductors are located within and along the deepest portion of said groove, the glass material of said heated first end not covering the terminations of said conductors, said terminations being substantially flush with the internal surface of said glass material;

applying a quantity of primer material through said opposing second open end portion of said glass tubing member such that said primer material will occupy said groove and contact said terminations of said conductors so as to bridge said terminations;

positioning a predetermined quantity of filamentary combustible material within said glass tubing member through said second open end portion; and thereafter tipping off said second open end portion of said glass tubing member to provide a seal thereat and thereby provide a hermetically sealed envelope, said method not including utilization of a glass bead or similar member in contact with the portions of said electrical conductors which project downwardly within said first open end portion of said glass tubing member during said heating and deformation thereof.

2. The method according to claim 1 wherein the portion of said electrical conductors which project downwardly in a vertical direction said predetermined distance within said first open end portion of said glass tubing member do not physically contact the internal surfaces of said glass tubing member prior to said heating and deformation of said first open end portion.

3. The method according to claim 1 wherein said pair of spaced-apart electrical conductors projecting downwardly in a vertical direction within said glass tubing member are oriented to occupy a plane substantially parallel to the longitudinal axis of said glass tubing member and passing therethrough during said heating of said preselected external areas of said first open end portion.

4. The method according to claim 3 wherein said heated preselected external areas of said first open end portion are located on opposing sides of said plane occupied by said downwardly projecting electrical conductors.

5. The method according to claim 1 wherein said preestablished temperature is within the range of from about 600 degrees Celsius to about 1150 degrees Celsius.

6. The method according to claim 1 further including the step of evacuating said glass tubing member through said second open end portion after said positioning of said combustible therein prior to said tipping off of said second open end portion.

7. The method according to claim 6 further including the step of introducing a quantity of combustion-supporting gas within said glass tubing member through said second open end portion subsequent to said evacuation of said member and prior to said sealing of said second open end portion.

8. The method according to claim 1 further including the step of engaging said terminations of said electrical conductors with a rod member while the heated glass material of said first end portion of said glass tubing member surrounds said conductors to force said conductors to pass through said heated glass material such that said terminations occupy said substantially flush position with said internal surfaces of said glass material.

9. A method of making an electrically-activated photoflash lamp, said method comprising:

securedly retaining an elongated glass tubing member having first and second opposing open end portions such that said first open end portion is located vertically above said second open end portion;

positioning a pair of spaced-apart electrical conductors within said first open end portion of said glass tubing member such that said conductors project downwardly in a vertical direction a predetermined distance within said first open end portion;

heating preselected external areas of said first open end portion of said glass tubing member having said conductors projecting therein to a preestablished temperature to cause said first open end portion of said glass tubing member to deform and surround said conductors projecting downwardly therein and provide a seal therewith, the glass material of said heated first end not covering the terminations of said conductors;

forming a small, substantially conical-shaped pocket within the internal surface of said heated and deformed first end portion of said glass tubing member such that said terminations of said conductors are substantially flush with said internal surface and are located on opposite sides of said pocket;

applying a quantity of primer material through said opposing second open end portion of said glass tubing member such that said primer material will occupy said conical-shaped pocket and contact said terminations of said conductors so as to bridge said terminations;

positioning a predetermined quantity of filamentary combustible material within said glass tubing member through said second open end portion; and thereafter tipping off said second open end portion of said glass tubing member to provide a seal thereat and thereby provide a hermetically sealed envelope, said method not including utilization of a glass bead or similar member in contact with the portions of said electrical conductors which project downwardly within said first open end portion of said glass tubing member during said heating and deformation thereof.

10. The method according to claim 9 wherein the portion of said electrical conductors which project downwardly in a vertical direction said predetermined distance within said first open end portion of said glass tubing member do not physically contact the internal surfaces of said glass tubing member prior to said heating and deformation of said first open end portion.

11. The method according to claim 9 wherein said pair of spaced-apart electrical conductors projecting downwardly in a vertical direction within said glass tubing member are oriented to occupy a plane substantially parallel to the longitudinal axis of said glass tubing member and passing therethrough during said heating of said preselected external areas of said first open end portion.

12. The method according to claim 9 wherein said preestablished temperature is within the range of from about 600 degrees Celsius to about 1150 degrees Celsius.

13. The method according to claim 9 further including the step of evacuating said glass tubing member through said second open end portion after said positioning of said combustible material therein prior to said tipping off of said second open end portion.

14. The method according to claim 13 further including the step of introducing a quantity of combustion-supporting gas within said glass tubing member through said second open end portion subsequent to said evacuation of said member and prior to said sealing of said second open end portion.

15. The method according to claim 9 wherein said conical-shaped pocket is formed by securedly retaining said electrical conductors and moving said glass tubing member in a downward direction while said first end portion is heated and deformed about said conductors sufficiently to cause said terminations to occupy said substantially flush position on said opposite sides of said pocket.

16. The method according to claim 9 wherein said conical-shaped pocket is formed by securedly retaining said glass tubing member and moving said electrical conductors in an upward direction while said first end portion is heated and deformed about said conductors sufficiently to cause said terminations to occupy said substantially flush position on said opposite sides of said pocket.

17. The method according to claim 9 wherein said conical-shaped pocket is formed by securedly retaining said glass tubing member and said electrical conductors and simultaneously moving said glass member and said conductors apart while said first end portion is heated and deformed about said conductors sufficiently to cause said terminations to occupy said substantially flush position on said opposite sides of said pocket.

* * * * *